US006216597B1

(12) United States Patent
Bredy

(10) Patent No.: US 6,216,597 B1
(45) Date of Patent: Apr. 17, 2001

(54) PROJECTILE HAVING A RADIAL DIRECTION OF ACTION

(75) Inventor: Thierry Bredy, Asnieres les Bourges (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/193,248

(22) Filed: Nov. 17, 1998

(30) Foreign Application Priority Data

Nov. 20, 1997 (FR) ..... 97 14549

(51) Int. Cl.[7] ..... F42B 10/66
(52) U.S. Cl. ..... 102/476
(58) Field of Search ..... 102/522, 476, 102/211, 212, 213, 214; 244/3.21, 3.22, 3.23

(56) References Cited

U.S. PATENT DOCUMENTS

| | | | | |
|---|---|---|---|---|
| 4,160,415 | | 7/1979 | Cole . | |
| 4,242,962 | * | 1/1981 | Wakeman et al. | 102/213 |
| 4,245,560 | * | 1/1981 | Rambauske | 102/213 |
| 4,262,596 | * | 4/1981 | Allier et al. | 102/476 |
| 4,374,495 | * | 2/1983 | Thomanek | 102/476 |
| 4,614,317 | * | 9/1986 | Stavis | 244/3.19 |
| 5,386,951 | * | 2/1995 | Gaywood | 244/3.22 |
| 5,801,323 | * | 9/1998 | Kerdraon | 102/476 |
| 5,932,833 | * | 8/1999 | Hammon et al. | 102/213 |

FOREIGN PATENT DOCUMENTS

| | | |
|---|---|---|
| 3216142 | 6/1988 | (DE) . |
| 2406800 | 5/1979 | (FR) . |

* cited by examiner

*Primary Examiner*—Thomas Price
(74) *Attorney, Agent, or Firm*—Parkhurst & Wendel, L.L.P.

(57) ABSTRACT

The technical scope of the invention is that of projectiles comprising at least one payload associating at least one explosive warhead and at least one target sensor, such warhead having an inclined direction of action with respect to the projectile axis and whose initiation is triggered further to the detection of a target by the sensor, said sensor having an observation direction close to the action direction. The projectile incorporates scanning means enabling the payload, at a given time during the trajectory, to be provided with a ratio of longitudinal velocity V over spin rate Ω which is less than or equal to a limit value so as to ensure ground scanning in the observation direction at a sufficiently small pitch to enable a target to be detected.

5 Claims, 9 Drawing Sheets

PROJECTILE HAVING A RADIAL DIRECTION OF ACTION

BACKGROUND OF THE INVENTION

The technical scope of the invention is that of projectiles, notably direct-fire anti-tank projectiles, acting radially with respect to their objective.

Known projectiles comprise an explosive warhead, generally of the explosively-formed kind, whose initiation is triggered by the detection of a target by means of a sensor.

The sensors usually used employ infra-red or radar technology. Generally, these projectiles have means enabling their roll position to be controlled so as to keep their charge pointing in the required direction.

Patent FR-A-2,406,800 thus describes a projectile equipped with a radial action shaped charge. The drawback of such a charge is that it is necessary for complicated means to be provided to ensure its roll is controlled so that the charge can attain the target. These control means can only be activated once the target detection signals supplied by a high-performance nose-cone sensor have been exploited, such sensor notably being able to detect the target before the projectile has passed over it.

It would also be possible to design a projectile in which the warhead roll is stabilized so as to be permanently pointing in a vertical direction.

In addition to the sheer complexity of such a direction control, the roll stabilization of the warhead results in a reduction in the area of effectiveness of the projectile, which in this case must practically pass over its target in order to attack it.

It is notably impossible using such projectiles to attack a target placed in a different direction, for example a helicopter in low-flight located above or laterally with respect to the projectile.

SUMMARY OF THE INVENTION

The aim of the invention is to propose a projectile allowing such drawbacks to be overcome.

The projectile according to the invention has thus an enlarged area of effectiveness and can, in a simple manner which does not adversely affect flight stability, ensure the detection and destruction of a target located on the ground or perhaps even located above or laterally to the projectile.

The subject of the invention is thus a projectile, notably a direct-fire anti-tank projectile, comprising at least one payload associating at least one explosive warhead and at least one target sensor, such warhead having an inclined direction of action with respect to the projectile axis and whose initiation is triggered further to the detection of a target by the sensor, said sensor having an observation direction close to the action direction, wherein it incorporates scanning means enabling the payload, at a given time during the trajectory, to be provided with a ratio of longitudinal velocity V over spin rate Ω which is less than or equal to a limit value so as to ensure ground scanning in the observation direction with a sufficiently small pitch to enable a target to be detected.

The limit value will advantageously be selected equal to 3 m.

According to an essential characteristic of the invention, the scanning means comprise a device enabling the spin rate of the payload to be increased at a given time during the trajectory and/or a device to ensure translational braking for the payload.

According to a first embodiment, the device enabling the spin rate of the payload to be increased comprises at least one pyrotechnic booster whose direction of action is oriented such as to cause the payload to rotate around its axis.

According to a second embodiment, the translational braking device comprises at least one pyrotechnic booster, the direction of action of all the boosters being substantially the same as the payload axis.

According to another embodiment, the translational braking device comprises means to increase the aerodynamic drag of the payload.

According to a third embodiment, the payload is a sub-munition expelled from the projectile during its trajectory, such sub-munition carrying a braking device and/or a device to make it rotate with respect to the projectile.

The payload can be integral with the projectile, which incorporates a braking and/or rotational device.

The projectile can incorporate a proximity fuse intended to trigger the scanning means upon approaching a target.

The projectile can also incorporate timer means intended to trigger the scanning means at a certain time after the projectile has been fired.

The projectile can lastly comprise a receiver for a remotely-controlled signal, such signal intended to trigger the scanning means.

BRIEF DESCRIPTION OF THE DRAWINGS

The invention will be better understood after reading the following description of several embodiments, such description being made with reference to the appended drawings in which.

DESCRIPTION OF PREFERRED EMBODIMENT

Figure 1A:
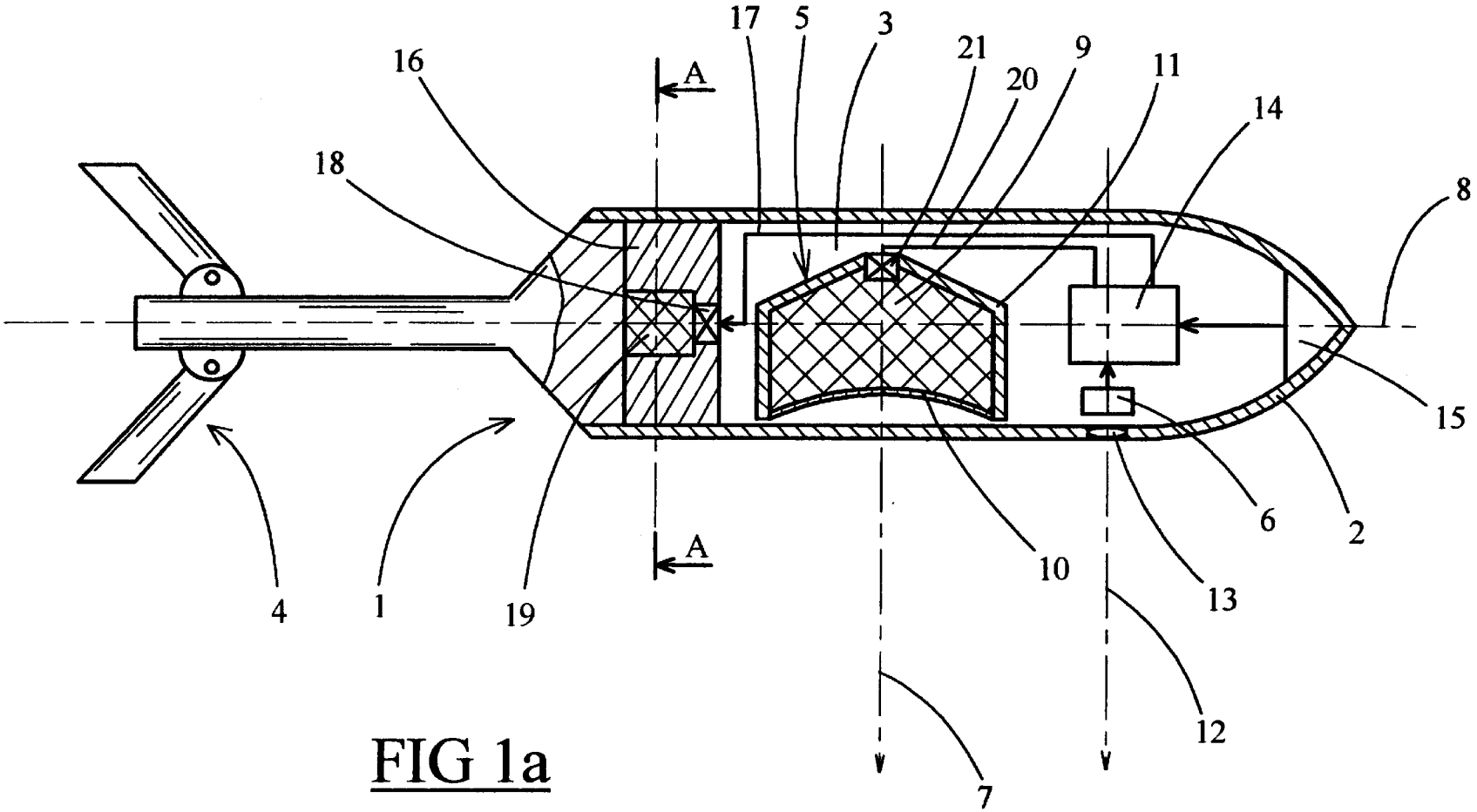
FIG. 1*a* schematically shows a longitudinal section of a projectile according to a first embodiment of the invention.
Figure 1B:
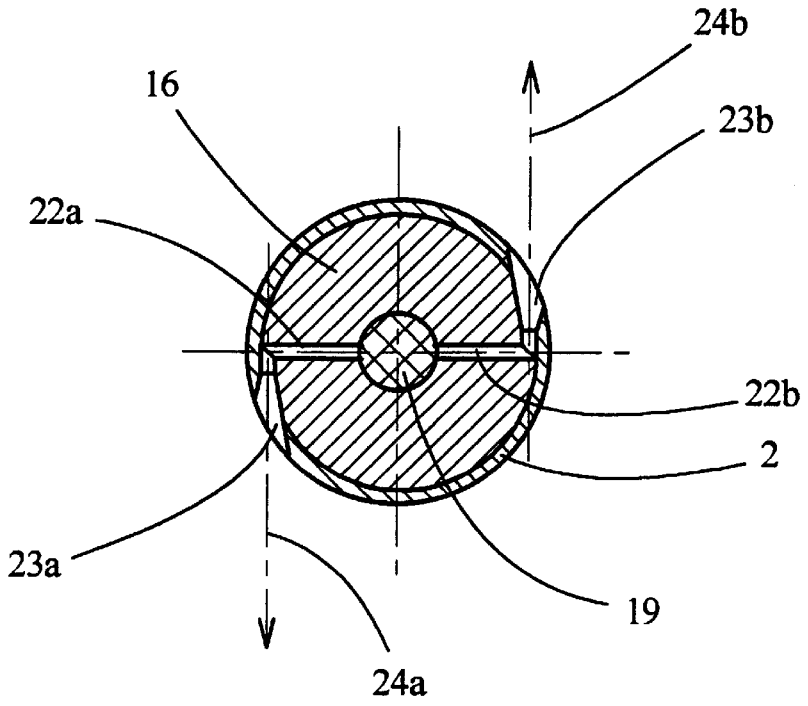
FIG. 1*b* is a cross section of this same projectile along the plane marked AA in FIG. 1*a*.

With reference to FIGS. 1*a* and 1*b*, a projectile 1 according to a first embodiment incorporates a casing 2 enclosing a payload 3 and extended at its rear part by a deployable tail piece 4.

The payload essentially comprises an explosive warhead 5 and a target detector 6.

The warhead has a direction of action 7 that is inclined with respect to axis 8 of the projectile. This direction of action is, in this case, substantially perpendicular to axis 8 of the projectile.

The warhead is an explosively-formed charge comprising in a known manner, an explosive charge 9 placed in a confining casing 11, such charge having a liner 10 applied to it.

Detector 6 is an infra-red sensor operating in the 3 to 5 micrometer range, for example, it is placed in proximity to a window 13, transparent to infra-red and arranged in casing 2 of the projectile. Detector 6 has a direction of observation 12 parallel to direction of action 7 of the payload.

Casing 2 of the projectile also encloses a processing unit 14 that receives the signals supplied by a timer 15 and by detector 6. This processing unit is intended to activate firstly, the triggering of a pyrotechnic device 16 enabling the spin rate of the projectile (and its payload) to be increased and, secondly, to cause the initiation of explosive charge 9.

To this end, the processing unit is linked by a first connection 17 to a squib 18 that ignites a pyrotechnic gas generator 19.

It is also linked by a second connection 20 to a primer 21 intended to ignite explosive charge 9.

Pyrotechnic device 16 can also be seen in the section view in FIG. 1*b*. Gas generator 19 is connected by radial piping 22*a*, 22*b* to gas expulsion nozzles 23*a*, 23*b*. These nozzles are oriented with respect to casing 2 of the projectile so as to expel the gases in two directions 24*a*and 24*b* that are symmetrical with respect to axis 8 of the projectile and in a perpendicular plane to it. The effect of the gases generated by generator 19 will thus be to make the projectile and its payload revolve around its axis 8.

The functioning of this projectile will now be described with reference to FIGS. 2*a* and 2*b*.

An infantryman 25 is equipped with a recoilless firing system 26 enabling a projectile 1 according to the invention to be launched.

This firing system will be fitted in a known manner by a laser range finder (not shown) enabling the determination of the distance D1 separating the firer from a target, such as a tank 27*a* or helicopter 27*b* (in this example, D1 is the mean distance).

The distance measurement enables the introduction into the processing unit 14 of programming for the trigger time of the gas generator 19.

The fire control integral with launcher 26 contains in different memories or directories the ballistic characteristics of the projectile (muzzle velocity, ballistic drag coefficient), such characteristics being introduced in the form of firing tables. It deduces from these tables, as a function of distance D1 at which the target is located, a time at which gas generator 19 must be activated so that the projectile is made to rotate at a distance D from the firer.

D will be chosen less than D1 by a few meters (around 15 m) to ensure the stabilization of the new spin rate before the projectile approaches or passes over the target.

This initiation time is introduced into the processing unit 14 in the form of a projectile flight time.

When firing of the projectile has been triggered, a sensor (non-shown, for example an accelerometer) detects the firing. Processing unit 14 thereafter takes the signals supplied by timer 15 into account to constantly determine the projectile flight time.

The projectile upon exiting launcher 26 spins at a moderate rate (around 10 revs/s) ensuring its stability during its trajectory. This spin is classically obtained by the cambering of tail fins 4.

When the programmed flight time has run out, processing unit 14 controls the ignition of gas generator 19.

Said generator is dimensioned so as to cause an increase in the spin rate of projectile 1 around its axis 8.

The increase in velocity must be such that the ratio $V/\Omega$ of the longitudinal velocity V of the projectile over its spin rate $\Omega$ is less than or equal to a limit value so as to ensure the scanning of the ground in the direction of observation at a pitch (P) that is reduced enough to allow a target to be detected.

The limit value (called scanning pitch) will generally be chosen equal to 3 m so as to ensure at least two scans of a land target such as a tank.

A person skilled in the art will easily dimension the gas generator enabling a projectile with a velocity V given in the vicinity of its range of effectiveness a spin rate $\Omega$ that will ensure the required scanning pitch.

Figure 2B:
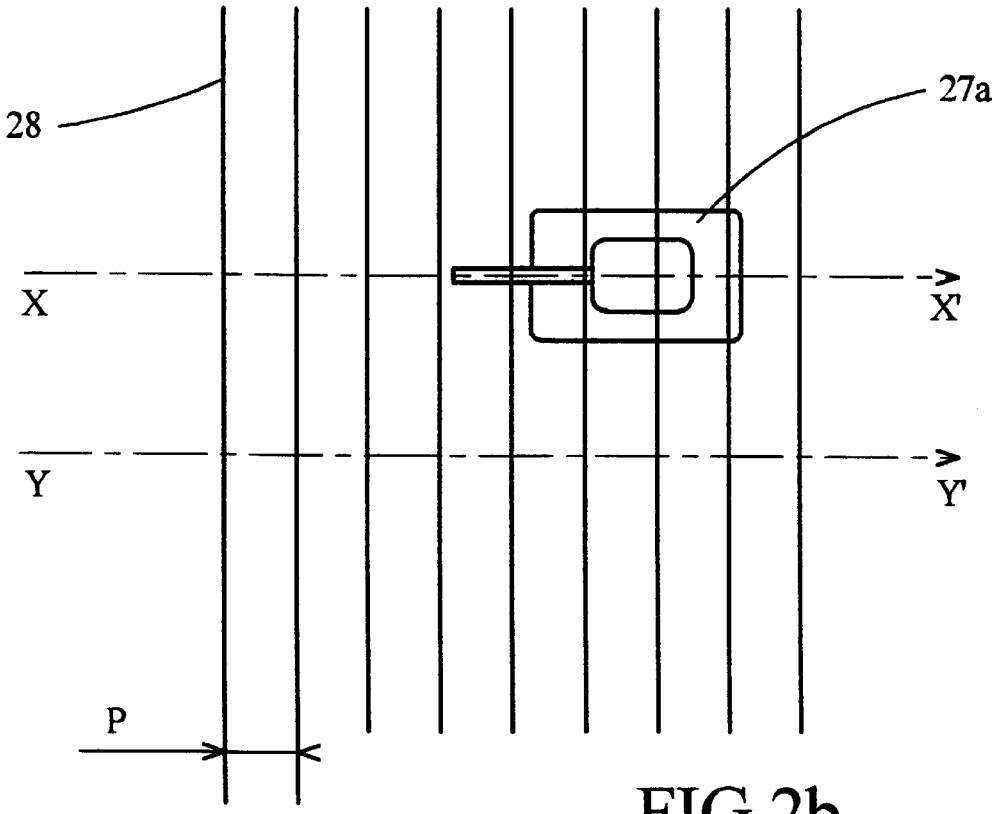
FIG. 2*b* is a representation of the ground trace of the observation direction.
Figure 2A:
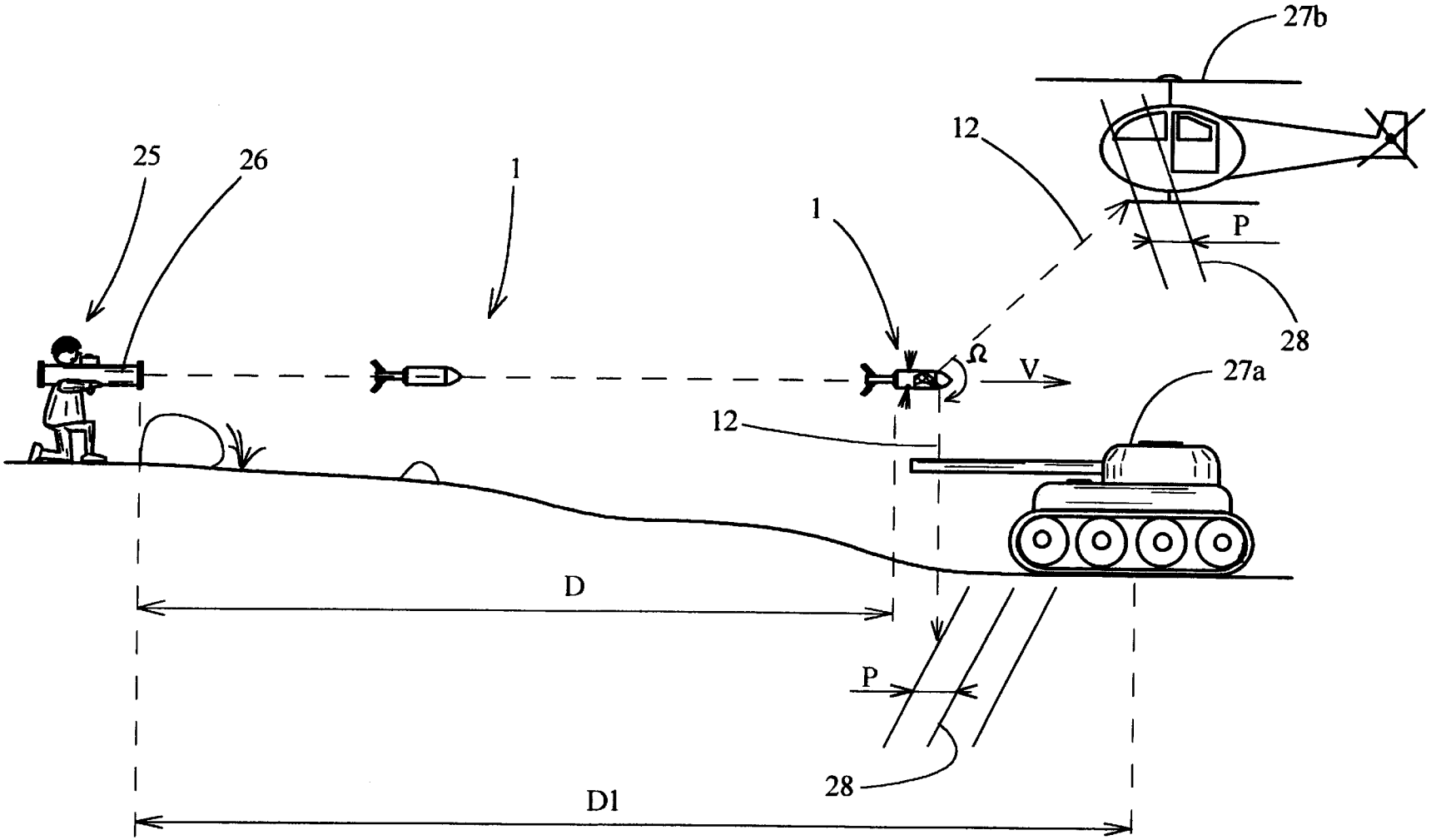
FIG. 2*a* shows the implementation of the projectile according to this first embodiment.

FIGS. 2*a* and 2*b* show traces 28 of the intersections between the observation direction 12 with the ground or a plane of the target.

The combination of spin rate $\Omega$ and axial velocity V of the projectile gives a helicoidal trajectory to observation direction 12.

Traces 28 are substantially rectilinear for a projectile whose observation direction 12 is perpendicular to the axis of the projectile 8 (as is the case here). They would be hyperbolic if the observation direction were inclined to the fore of the projectile.

Thanks to the invention, the pitch P is sufficiently reduced to ensure the detection of an appropriate target such as a tank.

When detector 6 detects a target whose infra-red signature corresponds to that memorized in processing unit 14, said unit causes the initiation of primer 21 and the firing of warhead 5.

The firing direction 7 of said warhead being substantially parallel to the observation direction, the slug formed by the charge will be projected towards the detected target.

The spin movement of the projectile ensures scanning by observation direction 12 of all the space surrounding the projectile.

It is thus possible to detect not only a land target 27*a* over which the projectile passes in an XX' direction (FIG. 2*b*), but also a target 27*b* that would be located laterally with respect to a flight direction YY' of the projectile (FIG. 2*b*).

As a result, with respect to known projectiles whose observation direction is invariable, there is an increase of the zone of effectiveness of the projectile which can detect and attack targets that it doesn't strictly pass over.

The projectile can also detect and attack an airborne target such as a helicopter 27*b*. Processing unit 14 will advantageously have memorized the infra-red characteristics of the different targets that the projectile is able to attack. It would in this case be possible to program the type of target searched for (tank or helicopter) before firing, in this case the processing unit will only activate the firing of the charge when a detected target effectively corresponds to the required target.

Means will advantageously be provided to ensure that signals supplied by detector 6 are not taken into account during the flight time and up to distance D. This would avoid false target detection.

To do this, processing unit 14 merely has to be given appropriate programming preventing any processing of the signals before a given time, said time would be computed by the firing control and would correspond to the time taken by the projectile to cover distance D.

The invention thus allows a multi-purpose (anti-tank or anti-helicopter) projectile to be designed using a relatively simple structure.

By way of a variant, it is possible to cause the projectile to spin, not further to the elapse of a programmed flight time, but further to the detection of the approach of a target having the given characteristics.

In this case, a proximity sensor will be provided, for example using radar, infra-red, acoustic or magnetometric technology, placed in the projectile nose cone (in place of the timer referenced 15 in FIG. 1*a*) able to detect the approach of a target at a distance of around 15 m.

The processing unit will utilize the signal supplied by this sensor to cause the initiation of gas generator 19.

It is also possible to provide remote-controlled means to trigger gas generator 19 from firing control 25.

In this case a signal transmitter (using optic, laser or radio technology) will be provided on the firing control and a suitable receiver will be placed in the projectile.

The firing control will, in this case, determine the optimal trigger time of means to measure the distance of the target and that at which the projectile is located.

It will transmit an order to the projectile to trigger the gas generator when the distance between projectile and target has reached the desired value.

It is also possible to use a pyrotechnic booster by way of scanning means, said booster incorporating not a gas generator but explosives. Such explosive boosters are well known to the expert and are described, for example, in patents FR-A-2,552,871 and FR-A-2,590,973, whose content related to the description of explosive boosters is included herein by way of reference.

In the previously described embodiments, the projectile is fitted with scanning means that allow a ratio to be ensured for the payload, at a given time during the trajectory, of the longitudinal velocity V over the spin rate Ω that is less than or equal to a limit value.

These scanning means are formed by a spin-generating pyrotechnic device 16 that incorporates a gas generator 19 enabling, for a given longitudinal velocity V, the increase in the spin rate Ω of the projectile. A ratio V/Ω is thus obtained that is less than the selected limit scanning pitch P.

It is possible for a projectile to be designed in which the spin rate Ω is not modified but where the longitudinal velocity V is reduced to ensure a ratio of V/Ω less than the limit value.

In this case, the scanning means will be formed of a braking device.

Figure 3:
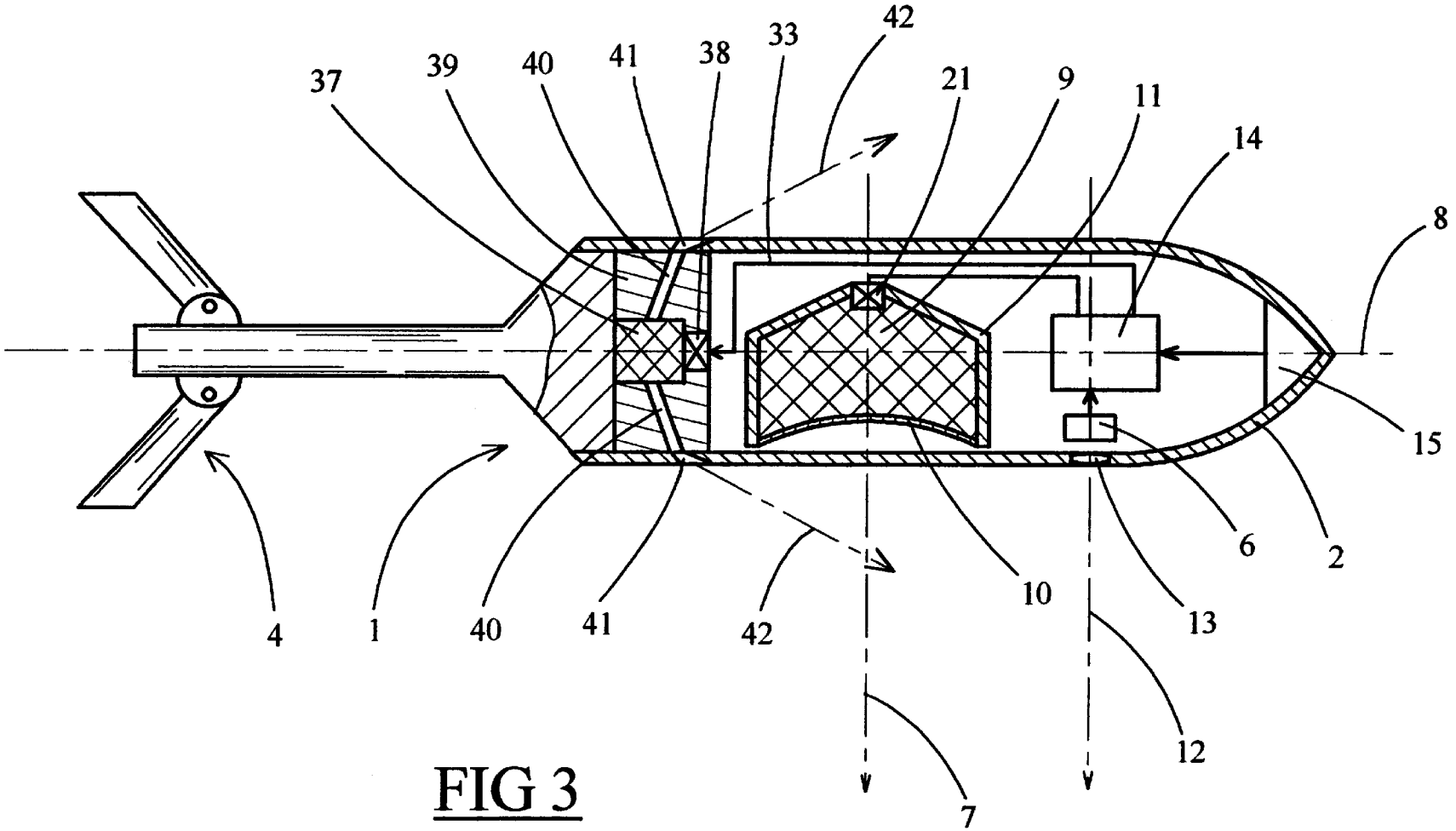
FIG. 3 is a schematic longitudinal section of a projectile according to a second embodiment of the invention.

FIG. 3 describes such an embodiment of the projectile according to the invention.

This projectile differs from the previously described one in that it incorporates in its rear part a translation braking device 39 in place of a spin-generating pyrotechnic device.

Said braking device incorporates a gas-generating pyrotechnic composition 37 initiated by a squib 38 connected to the processing unit 14 by a connection 33.

The rest of the payload 3 inside the projectile is identical to that of the previously described projectile. The projectile thus encloses an explosive warhead 5, a target detector 6, a processing unit 14 and a timer 15.

The gases generated by composition 37 are directed by piping 40 towards expulsion nozzles 41 evenly spaced radially and arranged in casing 2 of the projectile. These nozzles and axes materializing expulsion directions 42 that are inclined with respect to axis 8 of the projectile and are oriented to the front of the projectile.

The resultants of the braking load generated by each of the nozzles merge with axis 8 of the projectile.

Processing unit 14 will cause the priming of gas generator 37 at the required time thereby causing braking of the longitudinal velocity V of the projectile.

Figure 4:
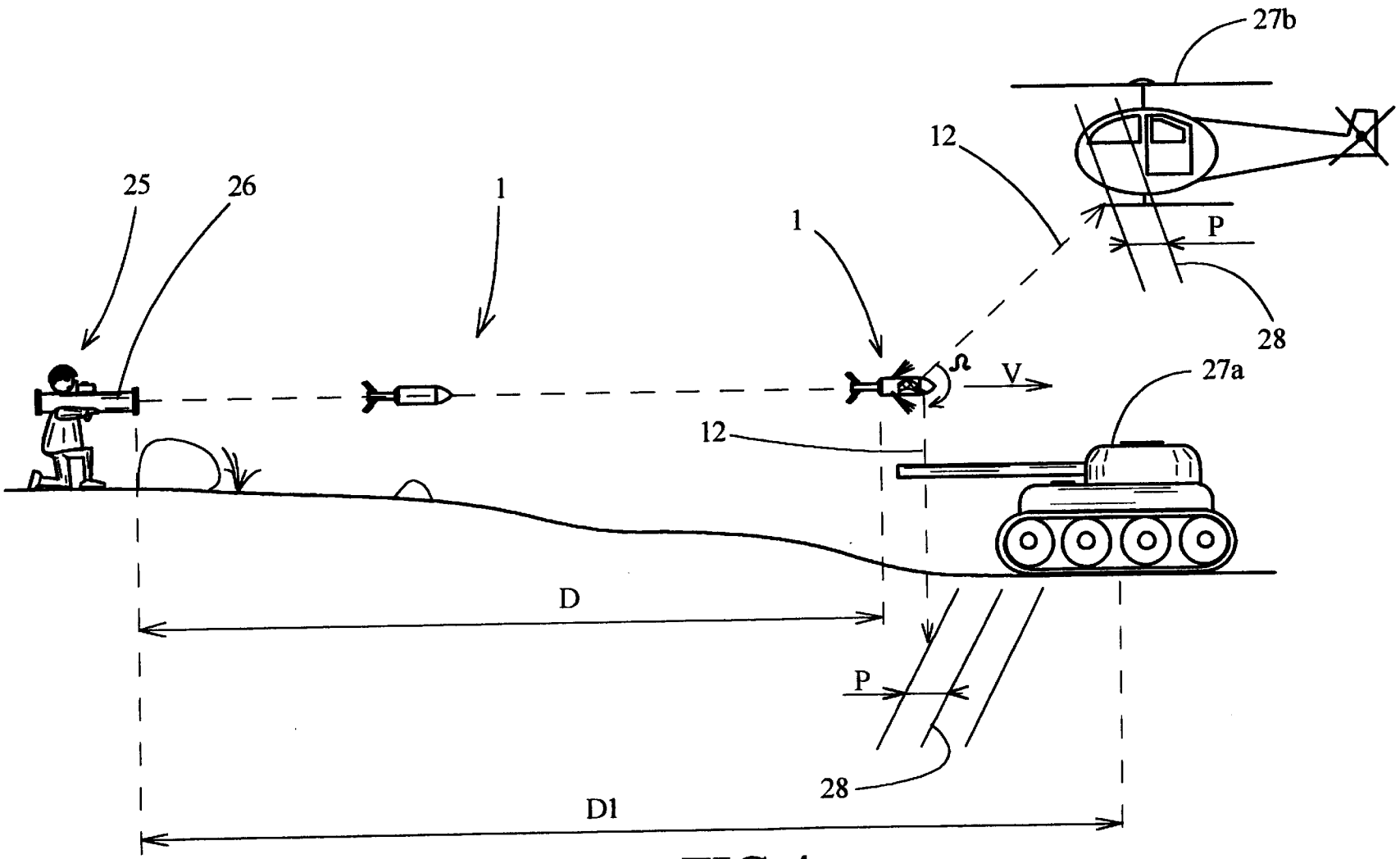
FIG. 4 shows the implementation of the projectile according to this second embodiment.

The functioning of this projectile will now be described with reference to FIG. 4.

Projectile 1 is once again fired from a recoilless firing system 26 implemented by an infantryman.

The processing unit is programmed by the infantryman using the data supplied by the firing control (not shown).

Projectile 1 is then fired, it has at this time a longitudinal velocity of around 200 m/s and a spin rate of around 35 revs/s.

When the projectile reaches programmed distance D, the processing unit causes the initiation of gas generator 37. The muzzle velocity of the projectile is reduced by around 50% and approaches 100 m/s. As a result the ratio V/Ωdrops to a value less than limit value P thereby enabling scanning of the ground in the observation direction at a sufficiently reduced pitch for the target to be detected.

The advantage of this embodiment lies in that the translation braking device does not implement any mobile parts and is thus extremely reliable.

By way of a variant, it is naturally possible to place a proximity sensor in the projectile nose cone that will automatically trigger braking of the projectile upon approaching a target.

It is also possible to provide a remote control for the braking device based on firing control 26.

It is possible to provide other types of translation braking means, for example means ensuring an increase in the aerodynamic drag of the projectile. A parachute can, for example, be provided, which is released at a given time during the trajectory. The parachute will be fastened free to rotate with respect to the projectile so as not to brake its rotation.

Figure 5A:
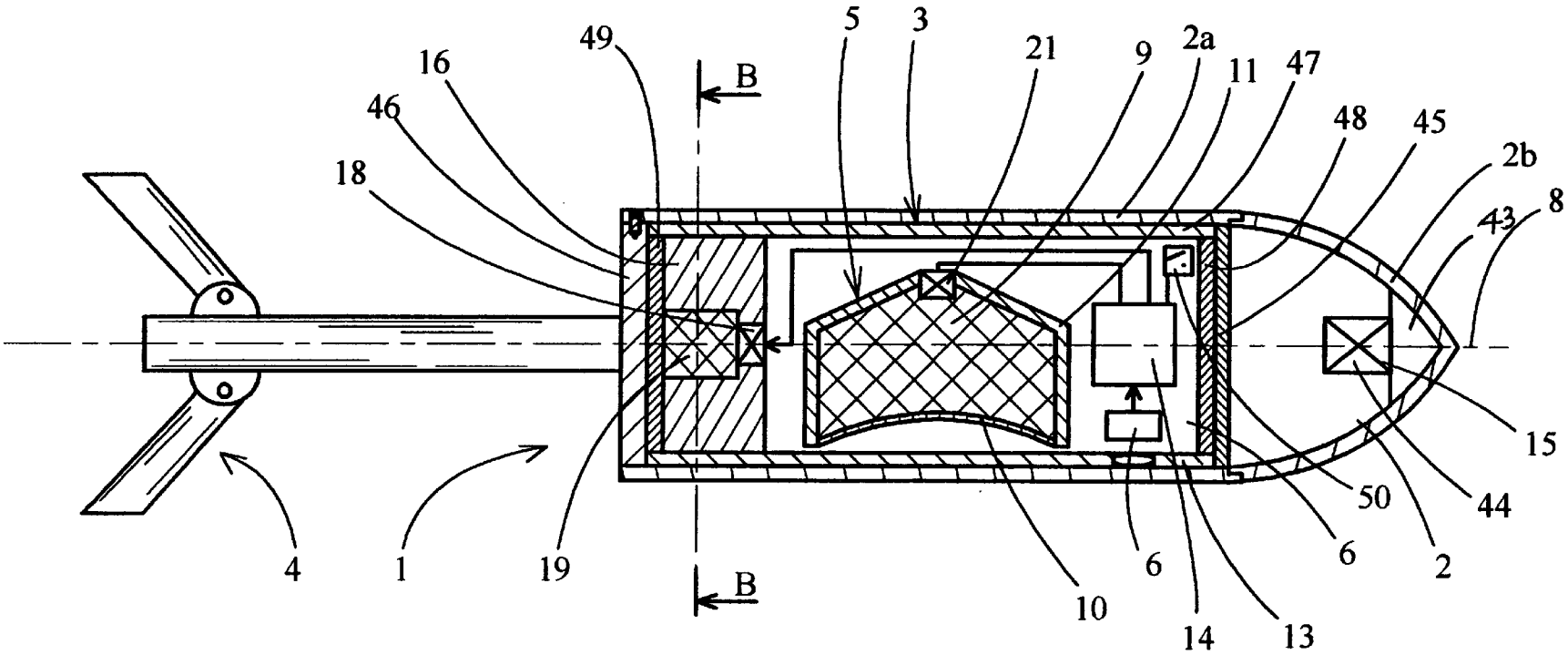
FIG. 5*a* is a schematic longitudinal section of a projectile according to a third embodiment of the invention.
Figure 5B:
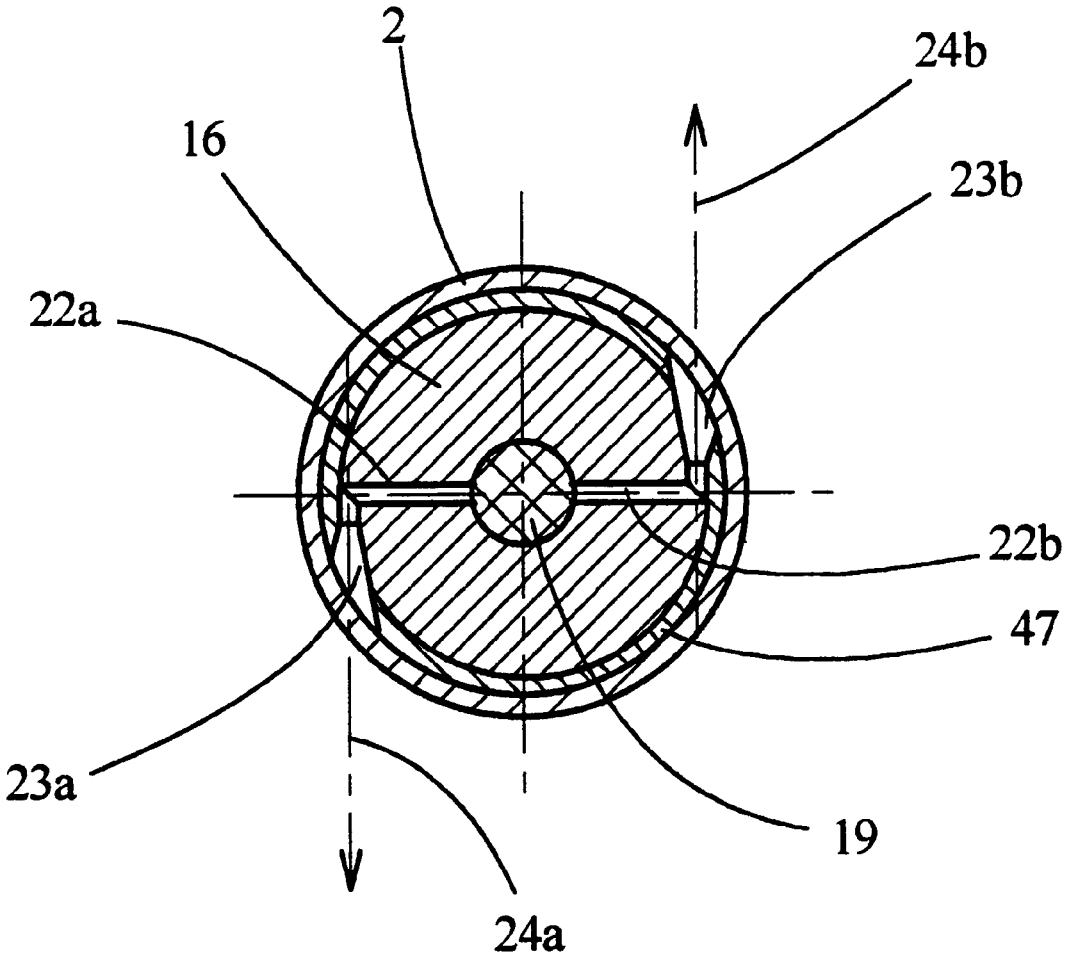
FIG. 5*b* is a cross section of this projectile along the plane marked BB in FIG. 5*a*, FIGS. 6*a* and 6*b* show two successive stages in the implementation of the projectile according to this third embodiment.

FIGS. 5*a* and 5*b* show a projectile according to a third embodiment of the invention.

This embodiment differs from the previous ones in that the payload 3 is formed by a sub-munition able to be expelled out of casing 2 of projectile 1 at a given time during the trajectory.

Casing 2 of projectile 1 thus comprises a rear cylindrical part 2a and a front nose part 2b enclosing a timer fuse 43 connected to an expelling charge 44.

The expelling charge is isolated from sub-munition 3 by a piston 45. The sub-munition is made integral in rotation with the casing by means of pins (not shown) which are sheared upon its expulsion.

The rear part of casing 2*a* is closed by a bottom 46 carrying tail piece 4.

Sub-munition 3 comprises a case 47 closed by two lids 48 and 49. Case 47 encloses an explosive warhead 5 as well as a target detector 6. There again, both warhead and sensor have respectively directions of action and detection substantially perpendicular to axis 8 of the projectile which merges with the axis of the sub-munition.

Sub-munition 3 also contains a processing unit 14 that receives the signals supplied by detector 6 and which controls the initiation of detonator 21 of warhead 5 and of squib 18 of a pyrotechnic gas generator 19.

The processing unit is also connected to an acceleration sensor 50 that is designed to detect the expulsion time of the sub-munition from casing 2.

A section view of gas generator 19 can also be seen in FIG. 5*b*. It is structurally analogous to that described previously with reference to FIGS. 1*a*, 1*b*.

Thus, it incorporates radial piping 22*a*, 22*b* linking pyrotechnic composition 19 to gas expulsion nozzles 23*a*, 23*b*. These nozzles are oriented with respect to case 47 of sub-munition 3 so as to expel the gases into two directions 24*a* and 24*b* that are symmetrical with respect to axis 8 of the projectile and of the sub-munition and in plane perpendicular to it. The effect of the gases generated by generator 19 will thus be to make the sub-munition revolve about its axis 8.

Figure 6A:
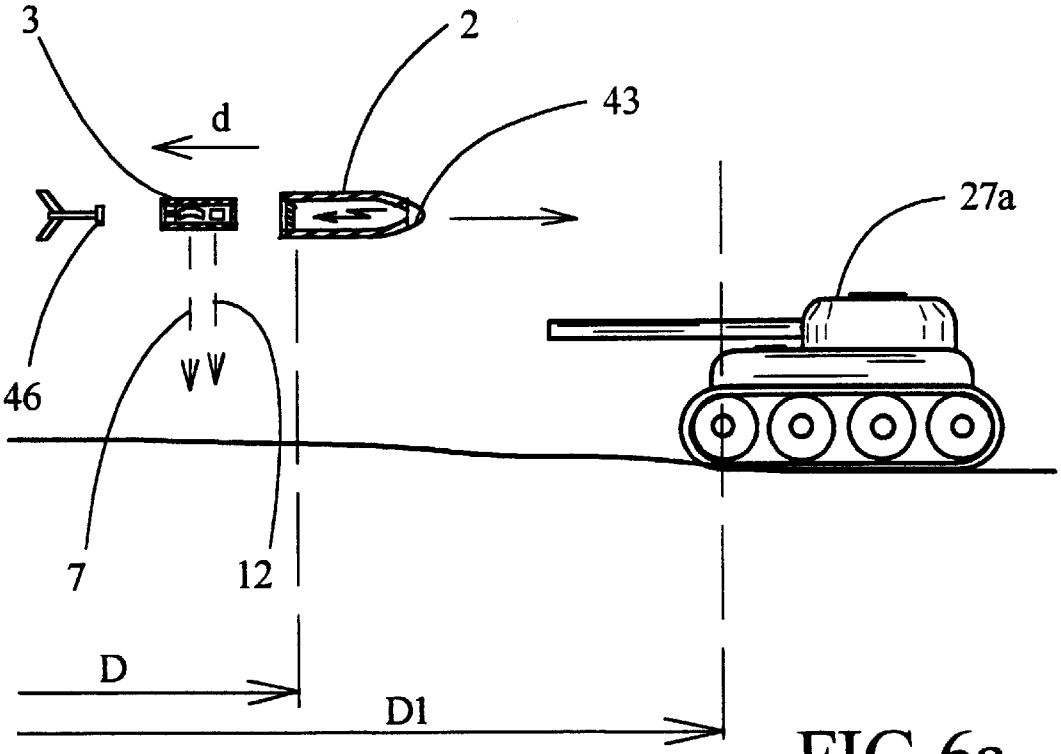
Figure 6B:
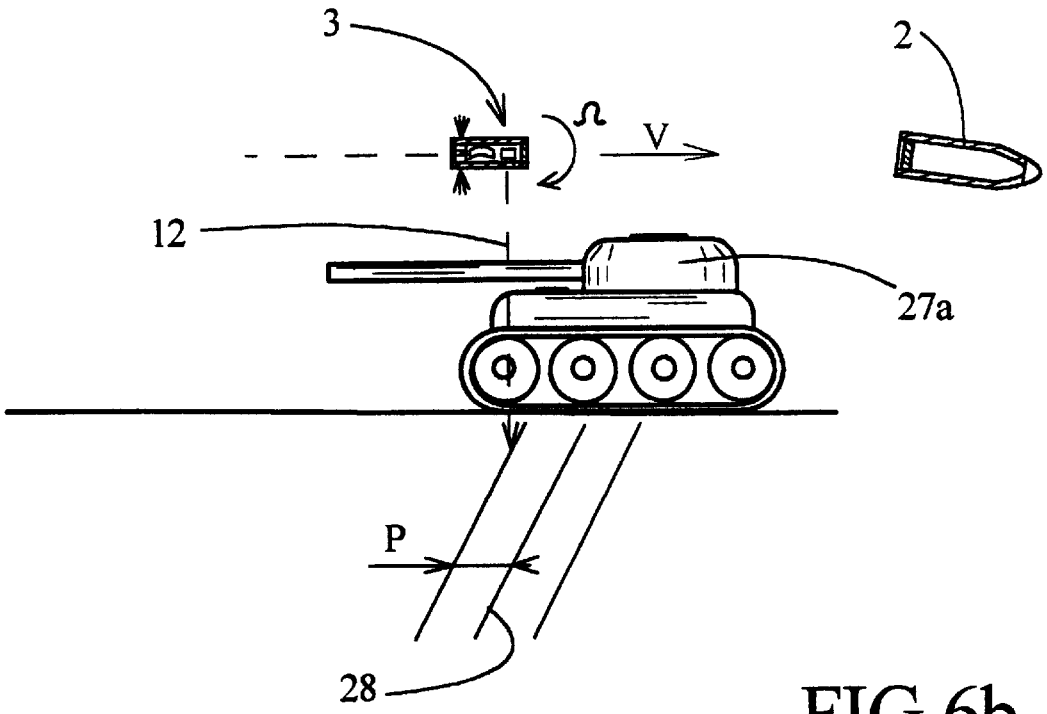

FIGS. 6*a* and 6*b* show two successive phases in the functioning of this embodiment.

The projectile is fired by a weapon system (not shown) and fuse 43 has (as for the other previous embodiments) received programming such that the initiation of expelling composition 44 occurs at distance D from the firer that is less than distance D1 firer/target.

The pressure of the expelling composition gases is exerted on piston 45, which pushes sub-munition 3 in direction d thereby shearing the pins maintaining bottom 46 of the projectile in place.

Sub-munition 3 is thus separated from casing 2 of the projectile (FIG. 6). It continues its longitudinal trajectory at a velocity V in the same direction as when it was inside the projectile and substantially at the same value (the mass of the sub-munition being much greater than that of casing 2 carrying fuse 43).

Acceleration sensor 50 detects the expulsion acceleration of the sub-munition thereby causing processing unit 14 to function which, after a memorized lapse of time, activates the priming of gas generator 19 (FIG. 6*b*).

The sub-munition has thus a higher spin rate.

The increase in its rate will once again be chosen such that the ratio V/Ω of the longitudinal velocity V of the sub-munition over the spin rate Ω is less than or equal to limit value P so as to ensure scanning of the ground in observation direction 12 at a sufficiently reduced pitch (P) to enable the detection of target 27*a*.

As for the previous embodiments, this embodiment can ensure detection of air-borne targets such a helicopters.

The advantage of using one or several sub-munitions lies in that the roll attenuation of the sub-munition or munitions is lower than for the full projectile. As a result, a high Ω is maintained for the payload.

A further advantage of such an embodiment lies in that, by using several sub-munitions, the zone of effectiveness of the projectile is improved.

Once again, by way of a variant, it is possible for timer fuse 43 to be replaced by a proximity fuse that will detect the approach of a target of given characteristics and will cause the expulsion of the sub-munition on approaching this target.

It is also possible to provide means enabling the expulsion of the sub-munition to be remotely-controlled at a desired time by the firer.

Lastly, it is possible for the ratio V/Ω to be varied by acting not on the spin rate of the sub-munition but on its longitudinal velocity V.

Figure 7:
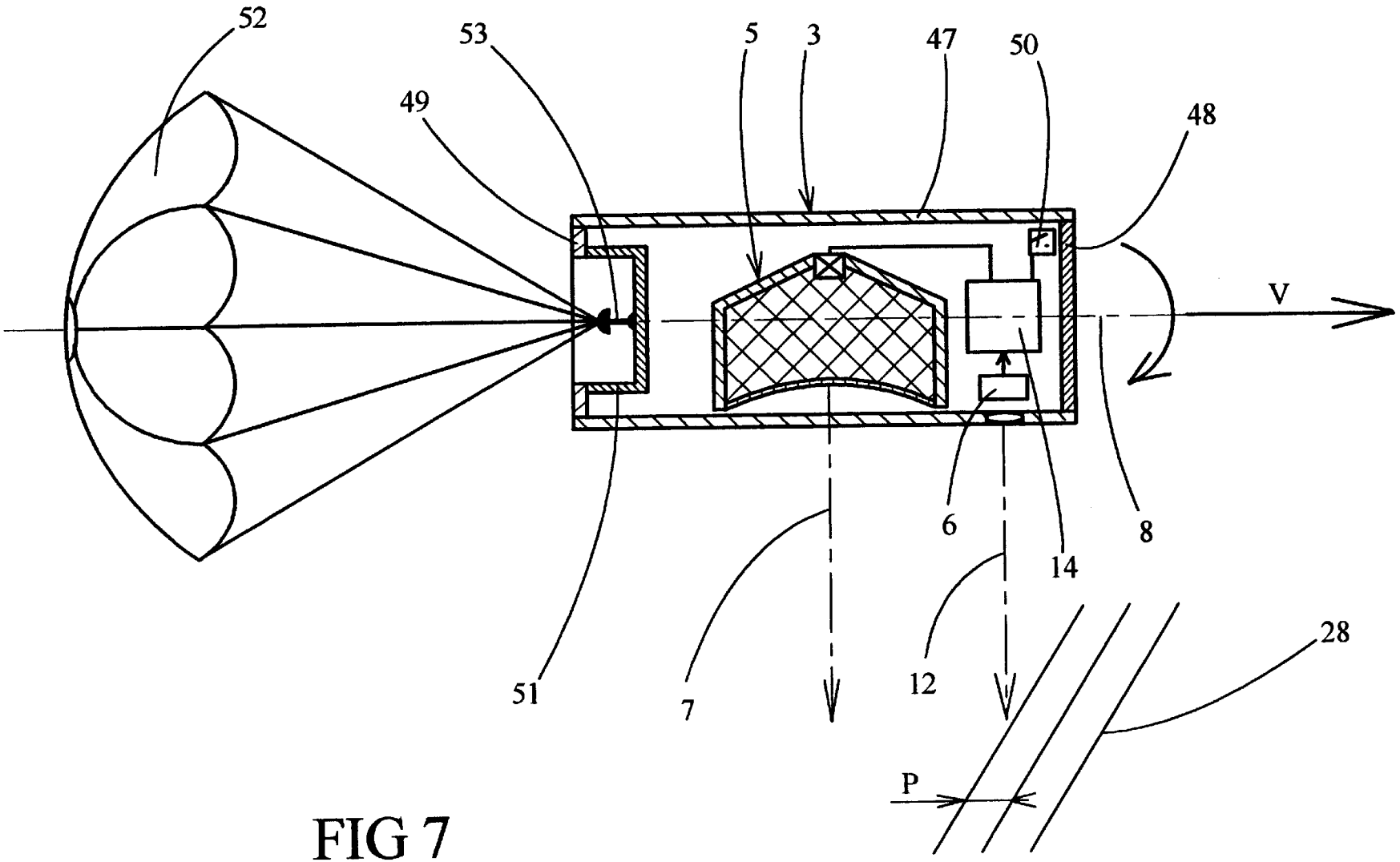
FIG. 7 shows a sub-munition according to a variant of this third embodiment.

FIG. 7 shows the implementation of a sub-munition 3 according to such a variant embodiment.

This sub-munition (shown here after its expulsion from the projectile casing) differs from the previous one in that it incorporates at its rear part a case 51 inside which a deployable parachute 52 is placed.

Sub-munition 3 is driven in rotation and translation by the projectile thanks to shearable pins (not shown).

After its expulsion it is therefore still spinning at a rate substantially equal to that of the projectile.

Parachute 52 is automatically deployed during expulsion because of the aerodynamic effects. The extraction of the parachute may possibly be aided and accelerated by providing a tearable link between parachute and bottom 46 closing the projectile.

This link (not shown) will be chosen fragile enough to break as soon as the bottom begins to exert traction upon it. Any interference between the bottom and the deployed parachute is thereby avoided.

Parachute 52 is connected to the sub-munition by linking means 53 that leave the sub-munition free rotate, for example a spindle that is immobile with respect to the sub-munition and on which a ring integral with the parachute revolves.

In this particular embodiment, the processing unit does not control the deployment of the aerodynamic braking means. These braking means automatically deploy after expulsion of the sub-munition, itself triggered at a suitable time by the projectile timer fuse.

The sub-munition still encloses an acceleration sensor 50 that detects the expulsion time and initializes the processing unit making it operational.

In this embodiment, velocity V is slowed down thereby ensuring a ratio V/Ω that is less than or equal to the desired limit value.

It is naturally possible for the different embodiments previously described to be combined so as to design a projectile having both axial braking means (of the projectile or the sub-munition) and means allowing the spin rate to be increased (of the projectile or of the sub-munition).

All the embodiments of projectiles described in the present application are made with reference to a firing from a recoilless weapon system.

It is naturally possible for a projectile to be designed according to the invention that can be fired using another type of weapon system and notably a tank cannon.

It is also possible for a projectile to be designed having several warheads and several target detectors or a projectile whose warhead is a splinter-generating charge along a specific direction of action.

What is claimed is:

1. A projectile, notably a direct-fire anti-tank projectile, comprising at least one payload associating at least one explosive warhead and at least one target sensor, such warhead having an inclined direction of action with respect to the projectile axis and whose initiation is triggered further to the detection of a target by the sensor, said sensor having an observation direction close to the action direction, wherein it incorporates scanning means enabling said payload, at a given time during the trajectory, to be provided with a ratio of longitudinal velocity V over spin rate Ω which is less than or equal to a limit value so as to ensure ground scanning in the observation direction at a sufficiently small pitch to enable a target to be detected.

2. A projectile according to claim 1, wherein said scanning means comprise a device enabling the spin rate of said payload to be increased at a given time during the trajectory and/or a device to ensure translational braking for said payload.

3. A projectile according to claim 2, wherein said device enabling the spin rate of said payload to be increased comprises at least one pyrotechnic booster whose direction of action is oriented such as to cause said payload to rotate around its axis.

4. A projectile according to claim 2, wherein said payload is integral with said projectile, which incorporates a braking and/or rotational device.

5. A projectile according to claim 1, wherein it incorporates timer means intended to trigger said scanning means at a certain time after said projectile has been fired.

* * * * *